US005449127A

United States Patent [19]

Davis

[11] Patent Number: 5,449,127

[45] Date of Patent: Sep. 12, 1995

[54] DISPENSER FOR ROLLS OF SHEET MATERIAL

[76] Inventor: Robert T. Davis, R.R. 2, Moulton, Iowa 52572

[21] Appl. No.: 167,567

[22] Filed: Dec. 14, 1993

[51] Int. Cl.[6] ..... B65H 16/02; B65H 19/10

[52] U.S. Cl. ..... 242/560; 242/598.3; 242/598.6

[58] Field of Search ..... 242/590, 598, 598.3, 242/598.4, 598.5, 598.6, 559.3, 560.2, 560.3; 312/34.8, 34.19, 34.22; 225/77

[56] References Cited

U.S. PATENT DOCUMENTS

| | | | |
|---|---|---|---|
| 479,971 | 8/1892 | Carr | 242/598 |
| 2,908,450 | 10/1959 | Stone et al. | 242/598.6 |
| 3,157,370 | 11/1964 | Govatsos et al. . | |
| 3,413,049 | 11/1968 | Smay | 312/34.8 |
| 3,586,252 | 6/1971 | Sutton | 242/560.2 |
| 3,754,719 | 8/1973 | Choy | 242/598.3 |
| 4,098,469 | 7/1978 | McCarthy | 242/598.4 |
| 4,410,221 | 10/1983 | Vallis et al. | 312/39 |
| 4,520,968 | 6/1985 | Shpigelman . | |
| 4,564,148 | 1/1986 | Wentworth . | |
| 4,697,754 | 10/1987 | Duff . | |
| 4,844,361 | 7/1989 | Granger . | |
| 5,000,393 | 3/1991 | Madsen . | |

FOREIGN PATENT DOCUMENTS

| | | | |
|---|---|---|---|
| 3114869 | 10/1982 | Germany | 242/598.3 |
| 3621493 | 1/1988 | Germany | 242/560.2 |
| 5154068 | 6/1993 | Japan | 225/77 |
| 2108927 | 5/1983 | United Kingdom . | |

*Primary Examiner*—Daniel P. Stodola
*Assistant Examiner*—William A. Rivera
*Attorney, Agent, or Firm*—Zarley, McKee, Thomte, Voorhees, & Sease

[57] ABSTRACT

A dispenser for rolls of sheet material includes a base or housing for supporting one or more rolls of sheet material. An extension from one side of the housing includes a receiver for receiving one end of an axle/push rod. A journal is positioned on the opposite side of the housing from the receiver. The journal and receiver in turn are positioned along an axis. The axle/push rod has a first section which can be inserted into the center passageway through the roll and extend at least slightly out of the opposite side of the roll. A second section of the axle/push rod abutting the side of the roll has a diameter greater than the passageway through the roll and allows the axle/push rod to push the roll rotatably supported on the first section out of the housing. The entire length of the axle/push rod is greater than twice the length of a roll. The roll on the axle/push rod is then exposed outside the housing for dispension of sheet material. Once the roll exposed for dispension is expired, the axle is withdrawn from the receiver and withdrawn through the housing, with a half turn the remaining rolls drop in the housing and the axle right side up is reinserted into the next succeeding roll passageway. The axle/push rod is used to then push the next roll out to where it is positioned for dispension.

25 Claims, 5 Drawing Sheets

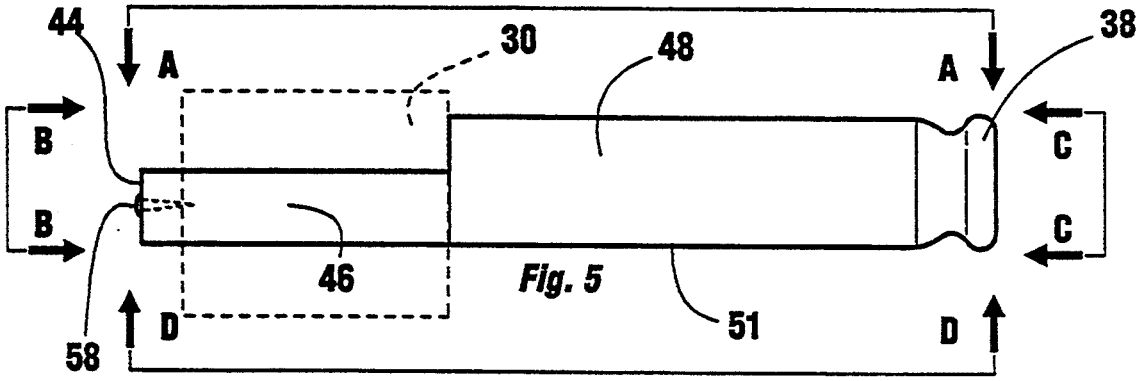
Fig. 5
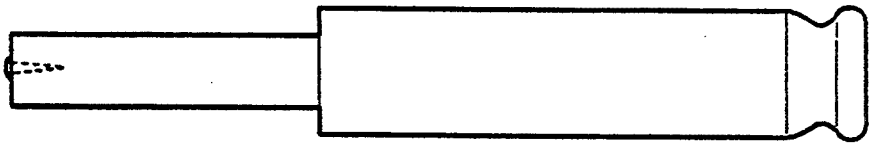
Fig. 6 A-A
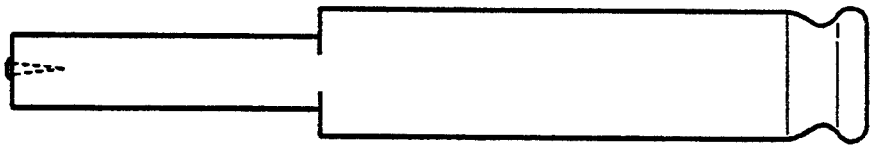
Fig. 7 D-D
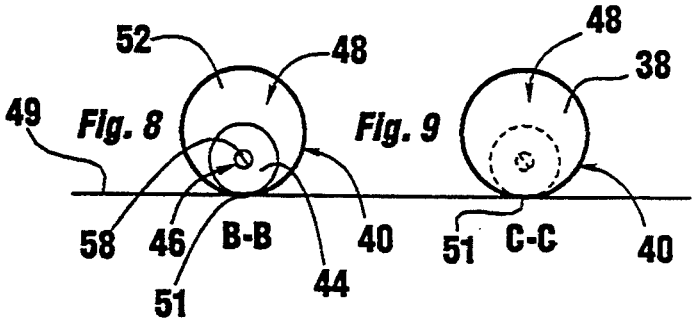

DISPENSER FOR ROLLS OF SHEET MATERIAL

REFERENCE TO DISCLOSURE DOCUMENT PROGRAM FILING

Disclosure Document No. 337680 has been previously filed regarding this invention.

BACKGROUND OF THE INVENTION

A. Field of the Invention

The present invention relates to the dispensing of sheets from rolls of continuous sheet material, and in particular, to a dispensing apparatus that rotatably supports such a roll to allow easy access and dispension of sheets of the material, and allows replacement of a roll, for example, when the predecessor roll has been depleted.

B. Problems in the Art

Conventional dispensers for rolls of sheet material, such as toilet paper rolls, paper towel rolls, and the like, consist of a spindle which is inserted through the center of the roll. The rolls usually have a cardboard tube along their center longitudinal axis upon which the roll of material is then wound. The spindle, once placed through the center of the roll, is then supported at opposite ends in some sort of receptacle. The roll can then be rotated either in the receptacle, or around the spindle, to allow for dispension of the sheets of material.

Such an arrangement is straight forward and generally acceptable for most uses. It does require the manual placement of the spindle into the roll, and then positioning of the spindle in the receptacle. It also requires the spindle to be removed from the cardboard tube and placed into a new roll if a change of rolls is desired. Also, such dispensers are generally limited to use with a single roll.

Therefore, there is room for improvement in the art. It is advantageous, at least in certain circumstances, to have multiple rolls available, without requiring the manual steps discussed above to change rolls. Several attempts have been made to provide devices towards this end. For example, below are listed several patents that purport to allow dispension of multiple rolls of material from a single apparatus:

| U.S. Pat. No. | INVENTOR/ COUNTRY | ISSUE DATE |
|---|---|---|
| 5,000,393 | Madsen - USA | 03/19/91 |
| 4,844,361 | Granger - USA | 07/04/89 |
| 4,520,968 | Shpigelman - USA | 06/04/85 |
| 4,697,754 | Duff - USA | 10/6/87 |
| 4,410,221 | Vallis, et al. - USA | 10/18/83 |
| 2 108 927A | Bowater-Scott - Great Britain | 05/25/83 (Publication Date) |

Deficiencies or problems still exist irrespective of the above listed attempts. For example, all the above listed devices represent relatively complex structure. Some continue to involve the manual step of withdrawing a spindle and then replacing it into the replacement roll before a succeeding roll can be dispensed.

Therefore, room for improvement still exists with regard to simplicity, economy regarding both manufacture and sale, and with respect to the amount of manual involvement in operating the dispenser, including replacement of rolls.

It is therefore a primary object of the present invention to provide a dispenser of rolls of sheet material that improves upon the state of the art.

Further objects of the present invention include:

1. the storage, support, and availability of multiple rolls of material in a single apparatus;
2. minimization of the level of detail and amount of manual interaction with the dispenser when replacing rolls;
3. the provision of a simple yet reliable multiple roll dispenser; and
4. the provision of a multiple roll dispenser which is economical and non-complex to manufacture, use, and maintain.

These and other objects, features, and advantages of the present invention will become more apparent with reference to the accompanying specification and claims.

SUMMARY OF THE INVENTION

The present invention is an apparatus to dispense rolls of continuous sheet material and to allow the replacement of rolls once they are depleted. The invention includes a structure for supporting multiple rolls in a stacked relationship. A combination axle and push rod, having opposite ends, has a length greater than twice the length of a roll of sheet material. A receiver for one end of the axle is placed along an axis that coincides with the axis of one of the supported rolls (preferably the bottom-most roll) but is extended greater than the length of one of the rolls to the side of that roll. A journal which can receive and rotatably support the axle is positioned on the other side of the roll and generally along the same axis as the receiver. The axle has a diameter less than the diameter of the passageway through a roll of material, at least for a portion of its length. Intermediate the ends of the axle is a section or piece which is greater than the diameter of the passageway through a roll.

The invention operates by allowing the smaller diameter portion of the axle to be inserted through the roll and to extend beyond the far side of the roll. The portion of the axle greater in diameter than the passageway through the roll then abuts the opposite or near side of the roll, allowing the axle to function as a push rod to push the roll out of its original supported position towards the receiver. Once in the receiver, the axle is rotatably supported and in turn rotatably supports a roll which is accessible by a user. It also allows the remaining stack of rolls to be supported upon it, ready to be used in the future.

When a roll is depleted or desired to be replaced the axle is simply withdrawn portion of the roll and/or from the receiver, from any remaining cardboard tube (if any) of the roll being dispensed, and then out of the journal on the opposite side of the apparatus. Doing so then allows the succeeding roll in the stack to drop into alignment along the axis between the receiver and the journal. The axle/push rod is then inserted right side up through the journal and the center of the succeeding roll until the larger diameter portion of the axle/push rod abuts the near side of the roll. The axle/push rod is then pushed along the axis to move the succeeding roll towards the receiver until the far end of the axle/push rod is received in the receiver. A new roll is therefore available for dispension.

The invention can include additional features such as components to assist in holding the far end of the axle in the receiver. One example is utilization of a magnet in the receiver and a ferro-magnetic piece on the end of the axle/push rod. Other types arrangements are possible.

In one configuration, the axle/push rod can be rotated about 180° and serves to automatically eject the cardboard tube of the spent roll. The axle/pushed then is rotated 180° back to its original orientation to place a new roll in position for use.

Additional features, configurations and advantages of the invention will be apparent to one skilled in the art with reference to the remainder of the specification and claims.

BRIEF DESCRIPTION OF THE DRAWINGS

FIGS. 5–9 are projection views of the axle/push rod of the preferred embodiment of the present invention.

DETAILED DESCRIPTION OF THE PREFERRED EMBODIMENT

A. Overview

Figure 1:
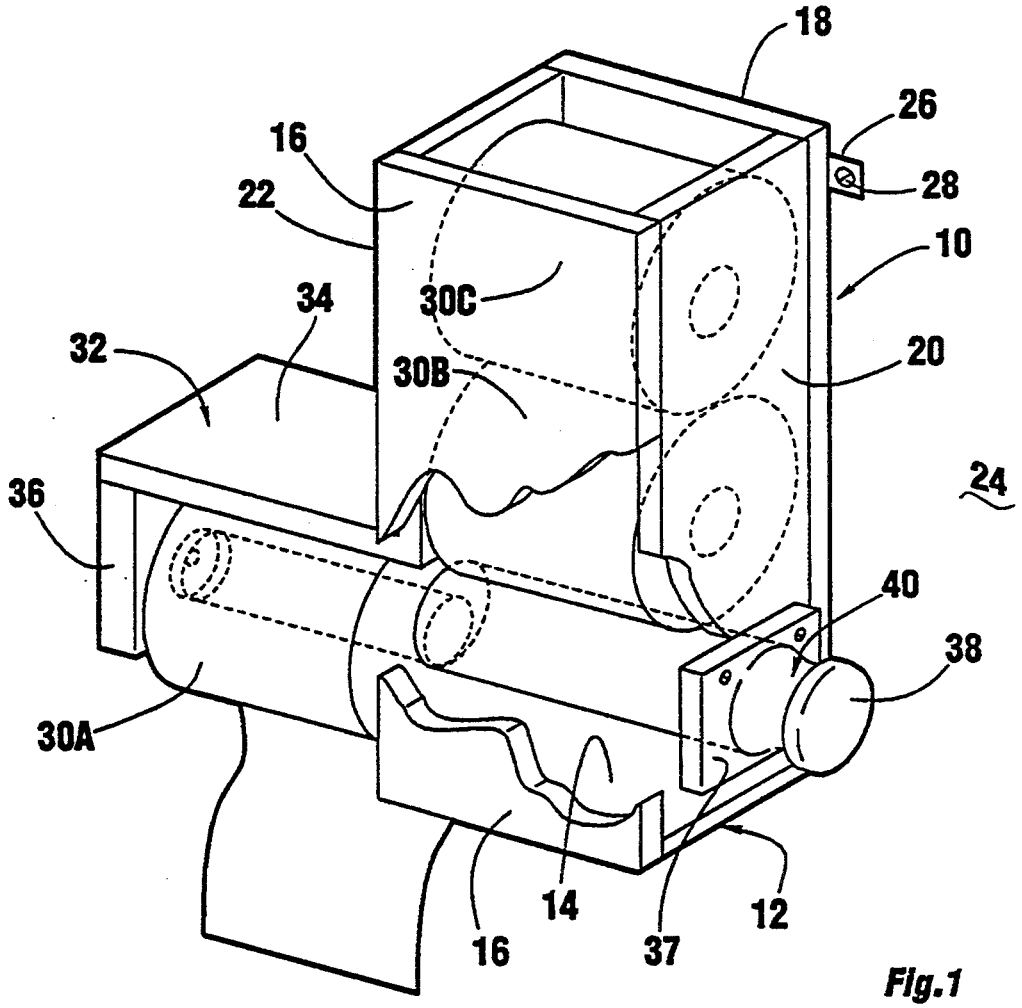
FIG. 1 is a perspective view of a preferred embodiment of the invention shown attached to a wall.

To allow a better understanding of the invention, a preferred embodiment will be described in detail below. It is to be understood that this preferred embodiment constitutes but one exemplary form the invention can take and does not specifically limit, nor is it intended to specifically limit, the scope of the invention.

In this description frequent reference will be taken to the appended drawings. Reference numerals will be used to specify certain parts or locations in the drawings. The same reference numerals will be used to indicate the same parts or locations throughout all of the drawings, unless otherwise indicated.

B. Description of Terms

Some of the terms used in this description refer generally to certain parts or functions of the invention. To be clear as to these terms, without unduly limiting their definition, for purposes of this detailed description the following terms will have the meaning as set forth below:

1. Axle/push rod 40 refers to the elongated, non-uniformly shaped shaft that includes a section which is used as an axle or spindle for a roll to be dispensed, and a section which is used to support the remaining rolls in the stack. It has the multiple functions of being an axle or spindle for the roll being dispensed, supporting any replacement rolls, and as a push rod to move succeeding rolls to a dispensing position. It will sometimes be referred to as axle 40, and sometimes as axle/push rod 40.
2. Receiver 36 refers to either a block or other structure extended away from the main part of the apparatus and which receives an outer end of the axle/-push rod. The receiver receives and rotatably supports an end of the axle/push rod but prevents it from lateral movement. The receiver can include components to assist in holding the end in place, such as magnetically attracted pieces. Other components to accomplish this function are also possible.
3. Journal 37 refers to a member which rotatably supports a portion of the axle/push rod a substantial distance away from the end which is placed in the receiver so that the axle/push rod can be rotatably supported at two spaced apart points.
4. Roll 30 (or 30 A, B, or C) refers to a roll of sheet material such as toilet paper rolls, paper towel rolls, and the like. It is not limited, however, to toilet paper or paper towel rolls. The meaning of the term roll includes those with or without a central tube (such as a cardboard tube at the middle of paper tower or toilet paper rolls) which defines the passageway through the center of those rolls into which the axle can be inserted.

C. Structure of the Preferred Embodiment

FIG. 1 depicts in perspective the structure of a preferred embodiment of a dispenser 10 according to the present invention. A box-like housing 12, which can be made of sheet metal or plastic for example, has a bottom wall 14, front wall 16, back wall 18, right side wall 20, and left side wall 22. It is to be understood that a cover (not shown) could also be utilized if desired.

FIG. 1 shows that housing 12 can be attached to a wall 24 by mounting tabs or brackets 26 and screws 28, for example (only are shown—but others normally would be spaced around housing 12). Other means of connection such as are well within the skill of those skilled in the art are possible. Instead of mounting on wall 24, the dispenser 10 could be set upon a surface such as a countertop, or have some sort of attachment system to almost any surface.

Housing 12 serves to support and hold a plurality of rolls 30 in a stacked relationship (see rolls 30B and 30C), generally one on top of the other. It is to be understood that the rolls do not have to be precisely stacked in a vertical column, but it is preferred that a roll exert gravitational pressure on each roll beneath it so that as appropriate, rolls will automatically drop downwardly during replacement of rolls in dispenser 10 by moving the bottom-most roll out of housing 12, for example. This does not preclude a configuration where the rolls are not generally vertical. If, for example, housing 12 was positioned so its back wall 18 was horizontal, the rolls could be manually pushed towards bottom wall 14 to facilitate moving a succeeding roll into position to then be moved out to be dispensed.

FIG. 1 also shows that dispenser 10 has an arm 32 extending from the side 22 of housing 12. Arm 32 consists of extension 34 and receiver 36 at its outer end. Arm 32 serves to rotatably support a roll 30 (in FIG. 1 roll 30A) so that it can be accessed by a user to grab and tear off sheets of material on roll 30A.

FIG. 1 also shows one end 38 of axle/push rod 40. Axle 40 has a length greater than twice the length of a roll 30 and extends from end 38 (which is outside housing 12 in its position in FIG. 1), through housing 12, through roll 30A underneath arm 32, and into receiver 36. The portion of axle/push rod 40 near end 38 of axle 40 is rotatably supported in journal 37, and end 44 (see FIG. 2) of axle 40 is rotatably supported in receiver 36, when axle 40 is in the position shown in FIG. 1. End 38 basically functions as a handle for the operator to push and pull upon the axle 40 (and sometimes rotate axle 40). The precise function and structure of axle/push rod 40, according to the preferred embodiment, will be described in more detail later.

Therefore, FIG. 1 illustrates that dispenser 10 can present a roll 30A for use, as well as store one or more additional rolls 30B and 30C for subsequent use.

By referring to FIG. 1 in conjunction with FIGS. 2–9, the precise structure of the preferred embodiment is shown in more detail.

FIG. 1 shows dispenser 10 fully loaded and ready for operation.

Figure 2:
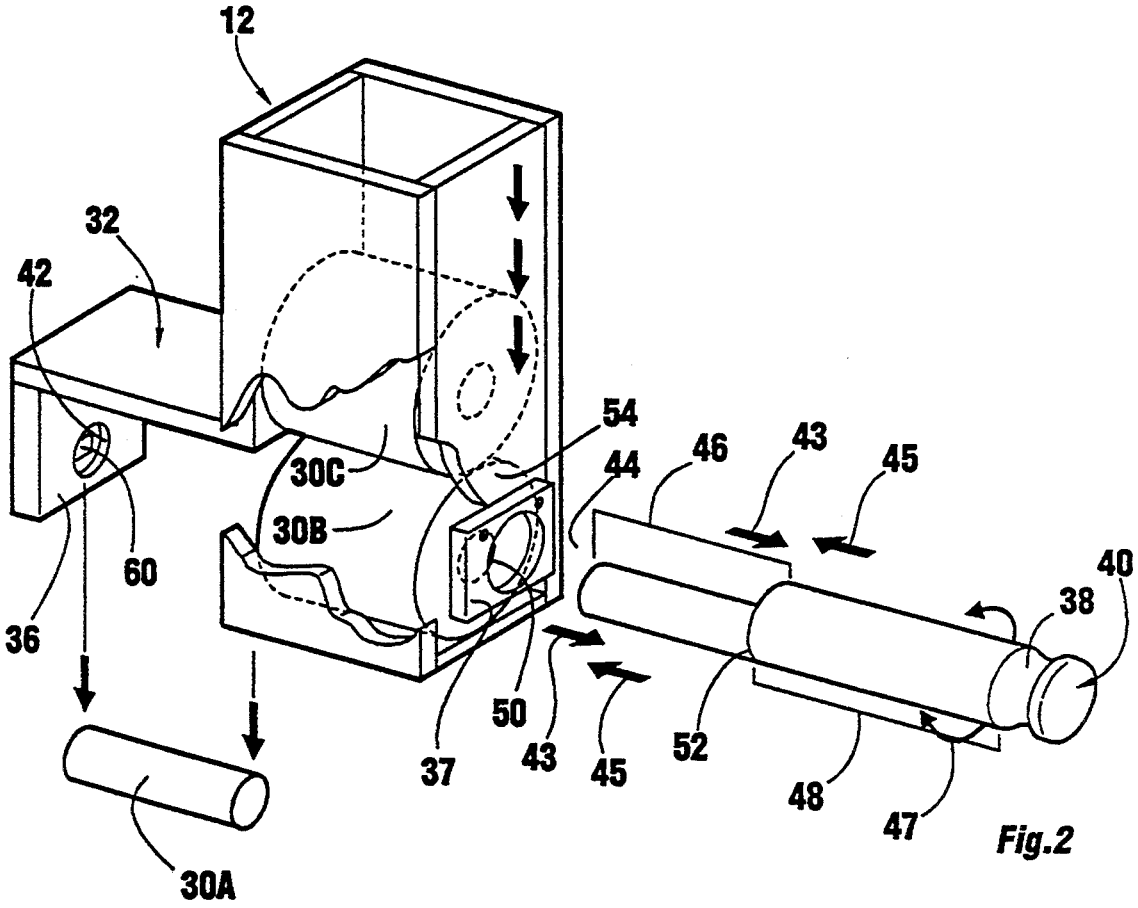
FIG. 2 is a perspective view of the invention of FIG. 1, but showing in cut away and ghost lines a stack of multiple rolls loaded into the device and the roll to be dispensed removed.
Figure 3:
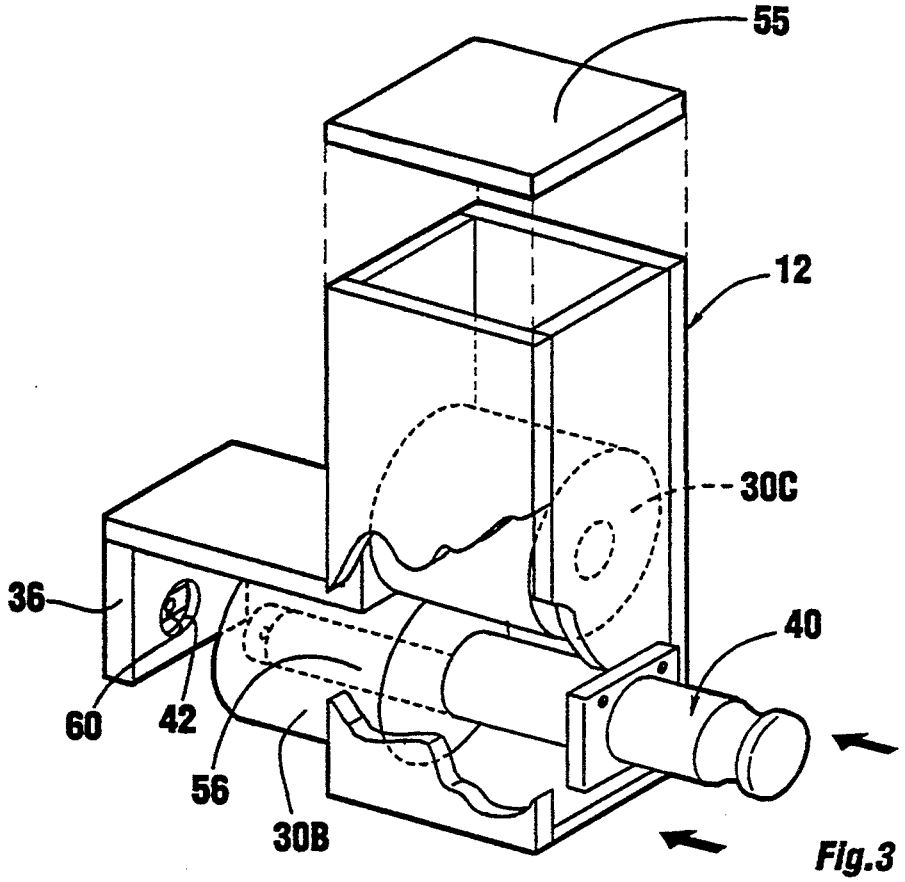
FIG. 3 a perspective view similar to FIG. 2 but showing the beginning of positioning of a roll in place for access and dispension of the sheets of the roll.
Figure 4:
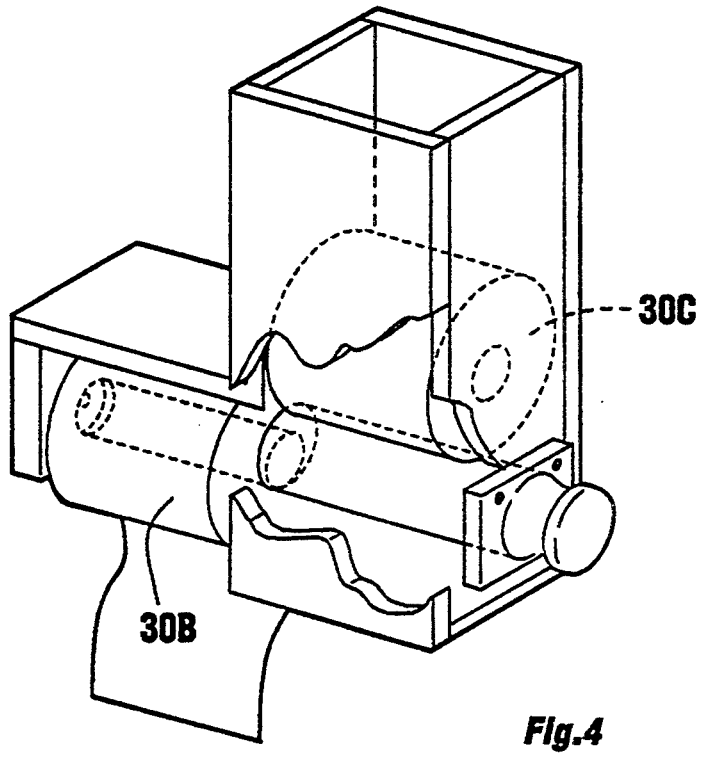
FIG. 4 is similar to FIG. 3 but showing completion of positioning of a roll for dispension.

FIGS. 2–4 illustrate the steps to take to replace depleted roll 30A with a succeeding roll 30B. First, axle 40 is removed completely from housing 12 (see direction of arrows 43). The remainder of roll 30A (usually a cardboard tube) is pulled off axle 40 and discarded.

Rolls 30B and C inside housing 12 then drop to the bottom of housing 12.

FIG. 2 shows that receiver 36 includes an circular indentation 42 to receive end 44 of axle 40. FIG. 2 shows in more detail the precise structure of an embodiment of axle 40. A first section 46 has a round-in-cross-section shape. The cross-sectional diameter of the first section or stage 46 is less than the inside diameter of the passageway 50 through any roll 30 so that it can be slid through passageway 50. Therefore, once rolls 30B and 30C have dropped down to the position shown in FIG. 2, axle 40 is reinserted into housing 12 (see direction of arrows 45). Note that axle 40 would need to be rotated (see arrows 47) so that section 46 is aligned with and can be pushed through opening 50 in roll 30B, and then the whole axle 40 pushed through journal 37 to push roll 30B to dispensing position. Section 46 of axle 40 must also be aligned with and mate into indentation 42 in receiver 36. The length of section 46 is greater than the longitudinal length of a roll 30 so that end 44 extends beyond the opposite end of a roll 30 so that it can be received into indentation 42 (see FIG. 5 where a roll 30 is shown in ghost lines on section 46).

A second section or stage 48 of axle 40 has a portion of cross-sectional diameter which is greater than passageway 50. It therefore cannot be pushed into or passed through passageway 50. When first stage 46 is pushed through passageway 50, the junction 52 of first and second stages 46 and 48 of axle 40 will then abut against the side 54 of roll 30. The length of the second stage 48 is longer than the longitudinal length of a roll 30, and specifically, is longer than the width of housing 12 so that end 38 extends outside of journal 37 when end 44 is in receiver indentation 42 (see FIG. 1). End 38 of axle 40 can have structure such as, for example, knurling or grooves, to assist the user in gripping end 38, if desired. Alternatively and optionally, a larger and/or separate piece could exist on end 38 to assist in gripping and use of axle 40.

Figure 11:
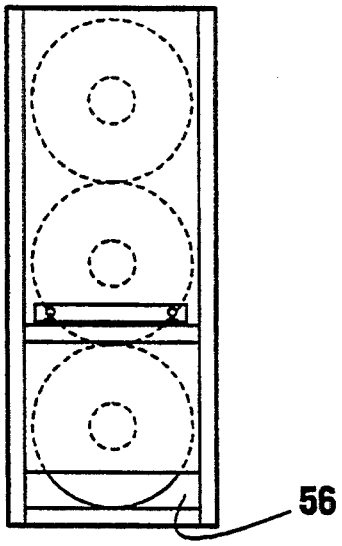
FIG. 11 is a side elevational view of FIG. 1 taken along line 10—10 of FIG. 1.
Figure 10B:
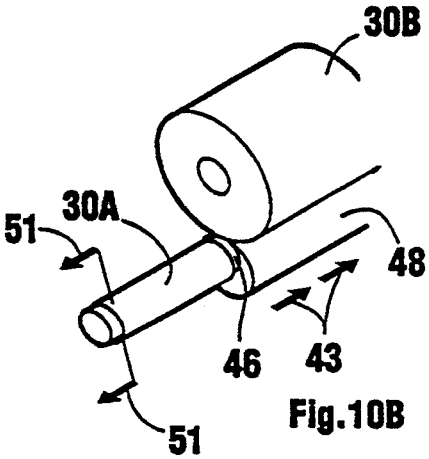

FIG. 3 illustrates that the side 22 of housing 12 has an opening 56 (refer also to FIG. 11) which is larger than the cross-sectional diameter of roll 30 to allow it to be pushed out of housing 12. FIG. 3 shows roll 30B being pushed through opening 56 towards the dispensing position. FIG. 3 also depicts an optimal removable top 55.

FIG. 4 shows roll 30B in the dispensing position.

FIGS. 5–9 show projection views of axle/push rod 40 of FIG. 2. In the preferred embodiment, section or first stage 46 has a generally uniform circular-in-cross-section diameter (see FIGS. 8 and 9). The second stage 48 has a generally uniform circular cross-sectional diameter which is larger than that of section 46 (see FIGS. 8 and 9). Moreover, the longitudinal axis of section 46 is offset downwardly from the longitudinal axis of section 48 so that what will be called the bottom of section 46 and the bottom of section 48 are coplanar (the plane represented by line 49 in FIG. 8) at least along a bottommost line (line 51 in FIG. 5 an end of which is shown by point 51 in FIG. 8). Note also that end 44 of axle 40 can include a ferro-magnetic member 58 (for example a steel screw) that can be used in conjunction with a magnet 60 (see FIGS. 2 and 3) placed into indentation 42. The magnetic attraction between magnet 60 and ferromagnetic member 58 would help hold end 44 of axle 40 into indentation 42, but allow easy separation of axle 40 from indentation 42. The magnet and ferromagnetic piece could be reversed in position, if desired. Alternative structure could be used to releasably assist in holding axle end 44 to receiver 36.

D. Operation of the Preferred Embodiment

By referring again to FIGS. 1–10, additionally discussion of operation of dispenser 10 will be set forth. FIG. 1 depicts dispenser 10 as attached to a vertical wall 24 with a roll 30A in place for dispension. Roll 30A therefore is easily accessible, similar to conventional single roll dispensers. Remaining rolls 30B and 30C are stored ready for use but out of sight. Loading of extra rolls 30 is easily accomplished through the top of housing 12. Axle 40 is in position through housing 12 and roll 30A and is nonobstructive but accessible.

Figure 10A:
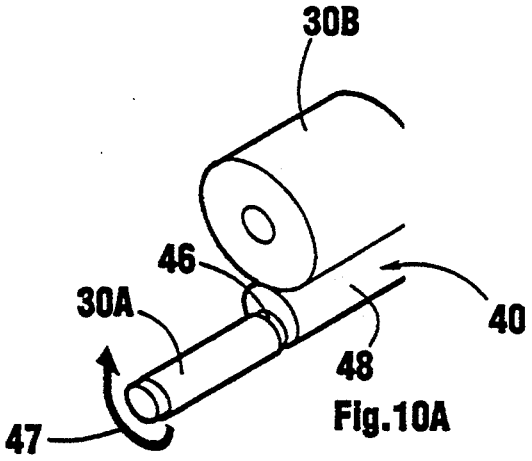
FIGS. 10 and 10B are isolated perspective views depicted how a spent roll can be automatically ejected.

Consider now the subsequent operation of dispenser 10. By referring to FIG. 2, in this embodiment two additional rolls 30B and C are stored and available in housing 12. No manual preparation of the rolls is required. Initial loading of up to three rolls into housing 12 is done with axle 40 completely removed. If any roll or roll center tube (shown by reference numeral 30A in FIG. 2), had been in place on dispenser 10, one would simply remove it from axle 40 when removing axle 40. One way this can be automatically accomplished is depicted in FIGS. 10A and B. When axle 40 is installed in the position of FIG. 1 (where its end 44 is in indention 42 of receiver 36), its rotational orientation is generally as shown in isolation in FIG. 10A. The section 46 of axle 40 is in its lowest position relative to section 48 of axle 40. Note that spent roll 30A (its removing cardboard tube is shown on section 46 of axle 40. Then, with a half turn of axle 40 (see arrow 47) which is resting on top of the empty roll 30A on portion 46 of pushrod 40 bumps the bottom of the next-in-line full roll 30B out portion 48 of push rod 40, so that section 46 is at its highest position, and by pulling axle 40 in the direction of arrows 43, is therefore ejected from section 46 when axle 40 is pulled out (see arrows 51).

To place a roll 30 into position for use, first stage 46 of axle 40 would be inserted into passageway 50 of the bottom most roll (like roll 30B in housing 12 in FIG. 2). Axle/push rod 40 would then be slid into passageway 50 and roll 30B until point 52 on axle 40 abuts side wall 54 of roll 30B. Axle 40 would then continue to be pushed to the left as shown in FIG. 3 which in turn would cause bottom most roll 30B to be pushed out opening 56 in side wall 22 of housing 12 (see FIG. 3). The stack of remaining roll(s) 30C in housing 12 would ride on top of the bottom most roll 30B during this action.

Axle/push rod 40 would continue to be moved to the left until end 44 of axle 40 is securely received into indentation 42 of receiver 36 (see FIG. 4). Roll 30B is therefore in position for dispension and the stack of remaining roll(s) 30C in housing 12 would fall and rest upon section or stage 38 of axle/push rod 40. When bottom-most roll 30B, now in position for dispension, is desired to be changed or is depleted, the process is repeated by first pulling out axle/push rod 40 to the position shown in FIG. 2 while at the same time removing the existing roll 30 with half turn for automatic ejection of its remaining center tube and/or any remaining toilet paper (see FIGS. 10A and B) and allowing the succeeding roll 30C in housing 12 to drop to the bottom of housing 12. Axle/push rod 40 would then be inserted into passageway 50 of the succeeding roll 30C and the process repeated pursuant to FIGS. 2–4 to move roll 30C out to a dispensing position.

It is noted that journal 37 and indentation 42 in receiver 36 must be positioned generally along a similar axis, and that in this preferred embodiment, floor 14 of housing 12 would support the bottom most roll 30 so that passageway 50 is aligned along that axis. Note also that extension 34 of arm 32 is positioned at least a distance greater than one half the cross sectional diameter of a roll 30 above indentation 42 to accommodate a full roll 30.

It can therefore be seen that dispenser 12 allows a plurality of rolls to be simply and easily replaced for dispension. It can also be seen that the structure is simple and economical in terms of manufacturing and in terms of marketability.

E. Alternatives, Options, and Features

It will be appreciated that the present invention can take many forms and embodiments. The true essence and spirit of this invention are defined in the appended claims, and it is not intended that the embodiment of the invention presented herein should limit the scope thereof.

For example, the exact structure of the components can vary within the scope of the invention.

Figure 12:
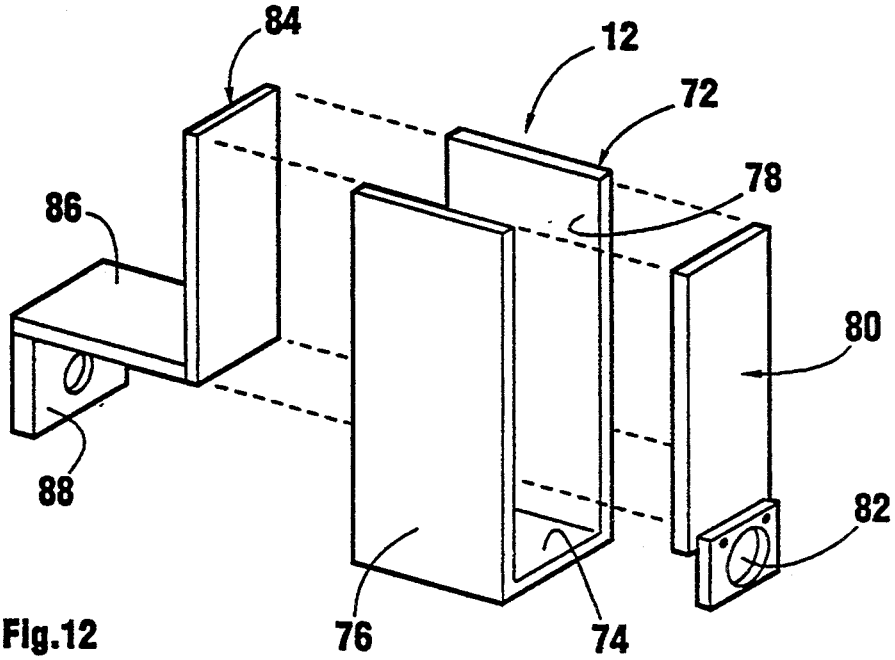
FIG. 12 is an exploded perspective view of the structure of an alternative embodiment according to the present invention.

FIG. 12 shows an alternative structure for housing 12. In this embodiment, a U-shaped member 72 has a bottom wall 74, a front wall 76, and a rear wall 78. A side wall 80, which includes a journal 82 can be connectable between front and back walls 76 and 78 on one side of member 72. A side wall 84 could be connectable between front and back walls 76 and 78 at the opposite side of member 72 and include a L-shaped extension 86 with a receiver 88 as shown. The configuration basically would function the same as previously described, but is essentially a three piece construction. Members 80, 84, and 72 could be connected by means well within the skill of those ordinarily skilled in the art, such as screws, bolts, welding, and adhesives. It might even be molded as a unitary piece.

What is claimed is:

1. A dispenser for rolls of continuous sheet material where the rolls have a center passageway, comprising:

a base support to support one or more rolls and having opposite ends;

a shaft having first and second opposite ends and a length greater than the end-to-end length of two of the rolls of the type being supported by the base support, and including a first section extending from said first end inwardly along the shaft that is insertable through the center passageway of the roll to support a roll for dispensing purposes, and a second section extending from said second end inwardly along the shaft and including a portion at or near a junction with the first section that will not pass through the center passageway of the roll which abuts the side of a roll when inserted on the first section, simultaneously supports the bottom of any additional rolls in the base support and causes a roll inserted on the first section to be pushed out of the base support to a dispensing position upon application of a force which is along or parallel to the shaft;

a receiver for receiving and rotatably supporting the first end of the shaft, held by structure connected to the base support at a distance away from the base support; and a journal for rotatably supporting the shaft at a position along the second section of the shaft.

2. The dispenser of claim 1 wherein the base support includes a bottom wall disposed below the second section of the shaft and coupled to the base support, the passageway of the roll defining an axis.

3. The dispenser of claim 2 wherein the base support comprises a box with the bottom wall coupled to a plurality of side walls.

4. The dispenser of claim 3 wherein one side wall is an L-shaped extension positioned above and coupled to the receiver.

5. The dispenser of claim 3 wherein the box has a removable top.

6. The dispenser of claim 3 further comprising a journal along one side wall at a height approximately aligned with said axis.

7. The dispenser of claim 6 wherein the receiver is positioned approximately along said axis.

8. The dispenser of claim 7 wherein the receiver is positioned away from the box approximately the length of one roll.

9. The dispenser of claim 3 wherein the box holds at least two rolls, the width of the box being approximately equal to the length of a roll.

10. The dispenser of claim 1 further comprising a retaining component which is releasable associated with the receiver to retain the first end of the shaft.

11. The dispenser of claim 10 wherein one of the receiver and the first end of the shaft includes a magnet, and the other of the receiver and the first end of the shaft includes a ferro-magnetic element.

12. The dispenser of claim 1 wherein the base support includes a U-shaped member consisting of integrally connected bottom, front and side walls.

13. The dispenser of claim 12 wherein a journal is mounted on the base support and comprises an opening slot and a side wall that is securable between the front and back walls of the U-shaped member.

14. The dispenser of claim 13 wherein the receiver is connected to a side wall that is securable between the front and back walls of the U-shaped member at an opposite side of the bottom wall from the journal.

15. The dispenser of claim 1 wherein the rolls are toilet paper rolls.

16. The dispenser of claim 1 wherein the rolls are paper towel rolls.

17. A dispensing mechanism for dispensing sheets from rolls of sheet material wrapped around a passageway through a center axis of the roll and for semi-automatic roll replacement comprising:

a container for supporting a plurality of rolls in a stackable arrangement;

a journal opening smaller than the diameter of a roll positioned in a side of the container in general alignment with the center axis through a first roll in the container;

a receiver connected to but positioned approximately the length of one roll and away from an opposite side of the container in general alignment with the center axis of the first roll;

an axle/push rod having a length greater than the end to end length of two rolls and including a first section having an outer diameter smaller than the inside diameter of the passageway through the center axis of the roll and a second section comprising a push member of a diameter greater than the diameter of the passageway of the roll so that the axle/push rod is adapted to be inserted laterally into the journal opening and extended to the receiver piece, the first section of the axle/push rod being inserted through the roll until the push member abuts a side of the roll and pushes the roll out of the container to a dispensing position wherein the end of the axle/push rod is inserted into the receiver, and the opposite end of the axle/push rod being rotatably supported in the journal opening, whereby upon removal of the axle/push rod from the receiver and container, the roll or any remainder thereof is removed, a next roll, if any, in the stack drops, and the axle is reinserted into the opening and the next roll pushed out for use.

18. The dispenser of claim 17 wherein the journal opening comprises a bearing surface for the axle/push rod.

19. The dispenser of claim 18 wherein the receiver includes a securement member which is releasable for the end of the axle/push rod.

20. The dispenser of claim 18 wherein the receiver includes a magnet.

21. The dispenser of claim 20 wherein the axle/push rod includes a ferro-magnetic piece.

22. The dispenser of claim 17 wherein the receiver comprises an opening having a diameter greater than the axle.

23. The dispenser of claim 17 wherein the axle/push rod is generally round in cross section.

24. The dispenser of claim 23 wherein the push member extends along the remainder of the axle/push rod from that portion which extends through the passageway of a roll.

25. The dispenser of claim 23 wherein the push member is positioned intermediate of ends of the axle/push rod.

* * * * *